US011112113B2

(12) United States Patent
Styborski et al.

(10) Patent No.: US 11,112,113 B2
(45) Date of Patent: Sep. 7, 2021

(54) AND MANUFACTURING PROCESS FOR DIRECTED IMPINGEMENT PUNCHED PLATES

(71) Applicant: United Technologies Corporation, Farmington, CT (US)

(72) Inventors: Jeremy Styborski, East Hartford, CT (US); Corey D. Anderson, East Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 429 days.

(21) Appl. No.: 15/992,454

(22) Filed: May 30, 2018

(65) Prior Publication Data

US 2019/0368734 A1 Dec. 5, 2019

(51) Int. Cl.
*F23R 3/06* (2006.01)
*F23R 3/00* (2006.01)

(52) U.S. Cl.
CPC ..... *F23R 3/002* (2013.01); *F23R 3/06* (2013.01); *F23R 2900/00018* (2013.01); *F23R 2900/03044* (2013.01)

(58) Field of Classification Search
CPC ..... F23R 2900/00018; F23R 2900/03044
See application file for complete search history.

(56) References Cited

U.S. PATENT DOCUMENTS 3,623,711 A 11/1971 Thorstenson
5,388,765 A 2/1995 Hill et al.
8,667,682 B2 3/2014 Lee et al.
(Continued)

FOREIGN PATENT DOCUMENTS

EP 0887612 A2 12/1998
EP 1635042 A1 3/2006
(Continued)

OTHER PUBLICATIONS

The Extended European Search Report for Application No. 19177548.5-1009; Report dated Sep. 13, 2019; Report Received Date: Sep. 18, 2019; 8 pages.
(Continued)

*Primary Examiner* — Todd E Manahan
*Assistant Examiner* — Alyson Joan Harrington
(74) *Attorney, Agent, or Firm* — Cantor Colburn LLP

(57) ABSTRACT

A gas turbine engine component assembly including: a first component having a first surface and a second surface opposite the first surface; and a second component having a first surface, a second surface opposite the first surface of the second component, and an impingement slot extending from the second surface of the second component to the first surface of the second component, the second surface of the first component and the first surface of the second component defining a cooling channel therebetween in fluid communication with the impingement slot, wherein the impingement slot is in fluid communication with the second surface of the first component, wherein the impingement slot includes a slot tab configured to direct airflow into the cooling channel at least partially in a lateral direction parallel to the second surface of the first component such that a cross flow is generated in the cooling channel.

6 Claims, 6 Drawing Sheets

(56) References Cited

U.S. PATENT DOCUMENTS

| | | | | |
|---|---|---|---|---|
| 2008/0092533 | A1* | 4/2008 | Tennison | F01N 13/082 60/317 |
| 2009/0084292 | A1* | 4/2009 | Cole | F23M 9/06 110/229 |
| 2015/0198335 | A1* | 7/2015 | Kim | F23R 3/02 60/760 |
| 2016/0333735 | A1* | 11/2016 | Bunker | F01D 9/023 |
| 2019/0128138 | A1* | 5/2019 | Krewinkel | F23R 3/002 |

FOREIGN PATENT DOCUMENTS

| | | | |
|---|---|---|---|
| EP | 2949866 | A1 | 12/2015 |
| WO | 2011020485 | A1 | 2/2011 |
| WO | 2016099662 | A2 | 6/2016 |

OTHER PUBLICATIONS

EP Office Action for Application No. 19 177 548.5-1009; Office Action dated Dec. 8, 2020; Office Action Received Date: Dec. 22, 2020; 5 pages.

* cited by examiner

AND MANUFACTURING PROCESS FOR DIRECTED IMPINGEMENT PUNCHED PLATES

BACKGROUND

The subject matter disclosed herein generally relates to gas turbine engines and, more particularly, to a method and apparatus for mitigating particulate accumulation on cooling surfaces of components of gas turbine engines.

In one example, a combustor of a gas turbine engine may be configured and required to burn fuel in a minimum volume. Such configurations may place substantial heat load on the structure of the combustor (e.g., heat shield panels, combustion liners, etc.). Such heat loads may dictate that special consideration is given to structures, which may be configured as heat shields or panels, and to the cooling of such structures to protect these structures. Excess temperatures at these structures may lead to oxidation, cracking, and high thermal stresses of the heat shields panels. Particulates in the air used to cool these structures may inhibit cooling of the heat shield and reduce durability. Particulates, in particular atmospheric particulates, include solid or liquid matter suspended in the atmosphere such as dust, ice, ash, sand, and dirt.

SUMMARY

According to an embodiment, a gas turbine engine component assembly is provided. The gas turbine component assembly including: a first component having a first surface and a second surface opposite the first surface; and a second component having a first surface, a second surface opposite the first surface of the second component, and an impingement slot extending from the second surface of the second component to the first surface of the second component, the second surface of the first component and the first surface of the second component defining a cooling channel therebetween in fluid communication with the impingement slot, the impingement slot is in fluid communication with the second surface of the first component, the impingement slot includes a slot tab configured to direct airflow into the cooling channel at least partially in a lateral direction parallel to the second surface of the first component such that a cross flow is generated in the cooling channel.

In addition to one or more of the features described above, or as an alternative, further embodiments may include that the slot tab is a portion of the second component formed in the second component by a punch manufacturing process.

In addition to one or more of the features described above, or as an alternative, further embodiments may include that the slot tab is planar in shape.

In addition to one or more of the features described above, or as an alternative, further embodiments may include that the slot tab is curved along a longitudinal axis of the slot tab.

In addition to one or more of the features described above, or as an alternative, further embodiments may include that the slot tab is curved around a longitudinal axis of the slot tab.

In addition to one or more of the features described above, or as an alternative, further embodiments may include that the impingement slot and the slot tab are triangular in shape.

According to another embodiment, a combustor for use in a gas turbine engine is provided. The combustor enclosing a combustion chamber having a combustion area. The combustor includes: a heat shield panel having a first surface and a second surface opposite the first surface; and a combustion liner having an inner surface, an outer surface opposite the inner surface of the combustion liner, and an impingement slot extending from the outer surface of the combustion liner to the inner surface of the combustion liner, the second surface of the heat shield panel and the inner surface of the combustion liner defining an impingement cavity therebetween in fluid communication with the impingement slot for cooling the second surface of the heat shield panel, the impingement slot includes a slot tab configured to direct airflow into the impingement cavity at least partially in a lateral direction parallel to the second surface of the first component such that a cross flow is generated in the cooling channel.

In addition to one or more of the features described above, or as an alternative, further embodiments may include that the slot tab is a portion of the combustion liner formed in the combustion liner by a punch manufacturing process.

In addition to one or more of the features described above, or as an alternative, further embodiments may include that the slot tab is planar in shape.

In addition to one or more of the features described above, or as an alternative, further embodiments may include that the slot tab is curved along a longitudinal axis of the slot tab.

In addition to one or more of the features described above, or as an alternative, further embodiments may include that the slot tab is curved around a longitudinal axis of the slot tab.

In addition to one or more of the features described above, or as an alternative, further embodiments may include that the impingement slot and the slot tab are triangular in shape.

According to another embodiment, a method of manufacturing a combustion liner for a combustor is provided. The method including: inserting a combustion liner between a support plate and a press plate including one or more teeth; and converging the press plate and the support plate together such that the one or more teeth of the press plate puncture the combustion liner to form one or more impingement slots through the combustion liner, each of the one or more impingement slots includes a slot tab bent away from the combustion liner by the one or more teeth of the press plate.

In addition to one or more of the features described above, or as an alternative, further embodiments may include that the support plate includes a trough configured to allow the one or more teeth of the press plate to bend the slot tab of each of the one or more impingement slots away from the combustion liner.

In addition to one or more of the features described above, or as an alternative, further embodiments may include that the trough is shaped to mirror a shape of the one or more teeth, such that the trough supports the supports the slot tab of each of the one or more impingement slots when the slot tab is bent by the one or more teeth.

In addition to one or more of the features described above, or as an alternative, further embodiments may include that a force is applied to the press plate to converge the press plate and the support plate together.

In addition to one or more of the features described above, or as an alternative, further embodiments may include that the slot tab is planar in shape.

In addition to one or more of the features described above, or as an alternative, further embodiments may include that the slot tab is curved along a longitudinal axis of the slot tab.

In addition to one or more of the features described above, or as an alternative, further embodiments may include that the slot tab is curved around a longitudinal axis of the slot tab.

In addition to one or more of the features described above, or as an alternative, further embodiments may include that the impingement slot and the slot tab are triangular in shape.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Combustors of gas turbine engines, as well as other components, experience elevated heat levels during operation. Impingement and convective cooling of heat shield panels of the combustor wall may be used to help cool the combustor. Convective cooling may be achieved by air that is channeled between the heat shield panels and a combustion liner of the combustor. Impingement cooling may be a process of directing relatively cool air from a location exterior to the combustor toward a back or underside of the heat shield panels.

Thus, combustion liners and heat shield panels are utilized to face the hot products of combustion within a combustion chamber and protect the overall combustor shell. The combustion liners may be supplied with cooling air including dilution passages which deliver a high volume of cooling air into a hot flow path. The cooling air may be air from the compressor of the gas turbine engine. The cooling air may impinge upon a back side of a heat shield panel that faces a combustion liner inside the combustor. The cooling air may contain particulates, which may build up on the heat shield panels over time, thus reducing the cooling ability of the cooling air. Embodiments disclosed herein seek to address particulate adherence to the heat shield panels in order to maintain the cooling ability of the cooling air.

Figure 1:
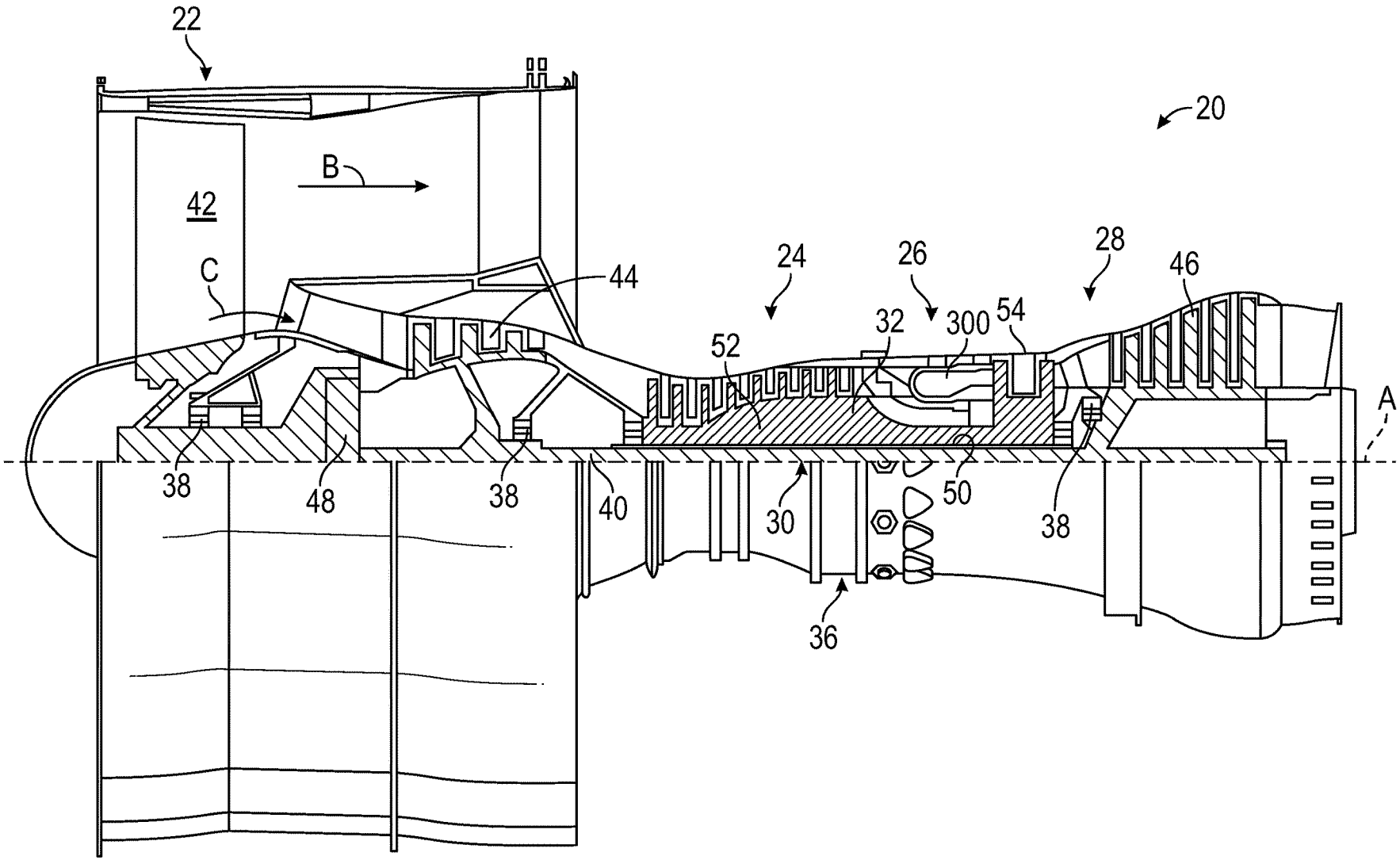
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 300 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 300, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
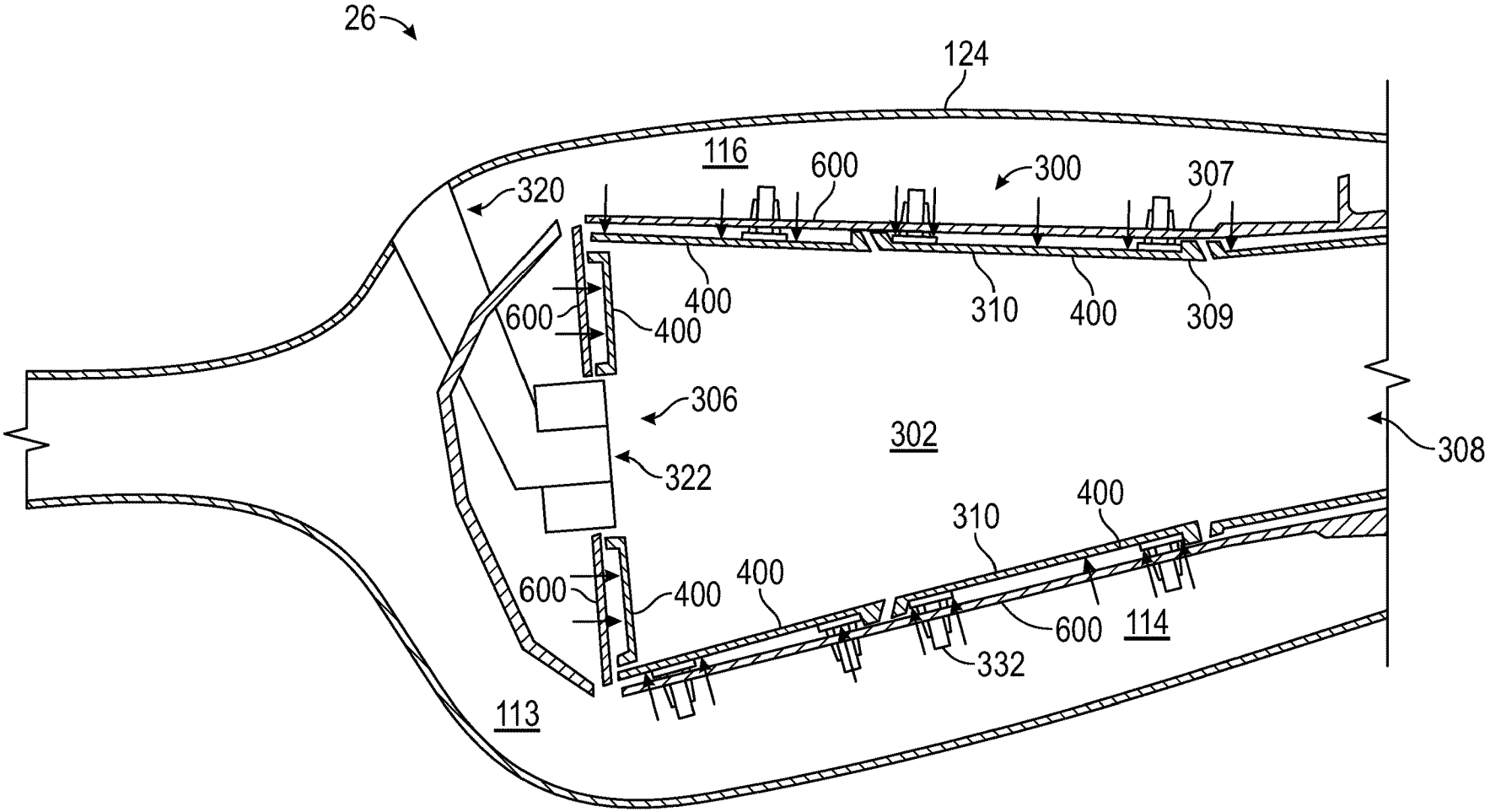
FIG. 2 is a cross-sectional illustration of a combustor, in accordance with an embodiment of the disclosure.

Referring now to FIG. 2 and with continued reference to FIG. 1, the combustor section 26 of the gas turbine engine 20 is shown. As illustrated, a combustor 300 defines a combustion chamber 302. The combustion chamber 302 includes a combustion area 370 within the combustion chamber 302. The combustor 300 includes an inlet 306 and an outlet 308 through which air may pass. The air may be supplied to the combustor 300 by a pre-diffuser 110. Air may also enter the combustion chamber 302 through other holes in the combustor 300 including but not limited to quench holes 310, as seen in FIG. 2.

Compressor air is supplied from the compressor section 24 into a pre-diffuser strut 112. As will be appreciated by those of skill in the art, the pre-diffuser strut 112 is configured to direct the airflow into the pre-diffuser 110, which then directs the airflow toward the combustor 300. The combustor 300 and the pre-diffuser 110 are separated by a shroud chamber 113 that contains the combustor 300 and includes an inner diameter branch 114 and an outer diameter branch 116. As air enters the shroud chamber 113, a portion of the air may flow into the combustor inlet 306, a portion may flow into the inner diameter branch 114, and a portion may flow into the outer diameter branch 116.

The air from the inner diameter branch 114 and the outer diameter branch 116 may then enter the combustion chamber 302 by means of one or more impingement holes 307 in the combustion liner 600 and one or more secondary apertures 309 in the heat shield panels 400. The impingement holes 307 and secondary apertures 309 may include nozzles, holes, etc. The air may then exit the combustion chamber 302 through the combustor outlet 308. At the same time, fuel may be supplied into the combustion chamber 302 from a fuel injector 320 and a pilot nozzle 322, which may be ignited within the combustion chamber 302. The combustor 300 of the engine combustion section 26 may be housed within a shroud case 124 which may define the shroud chamber 113.

Figure 3:
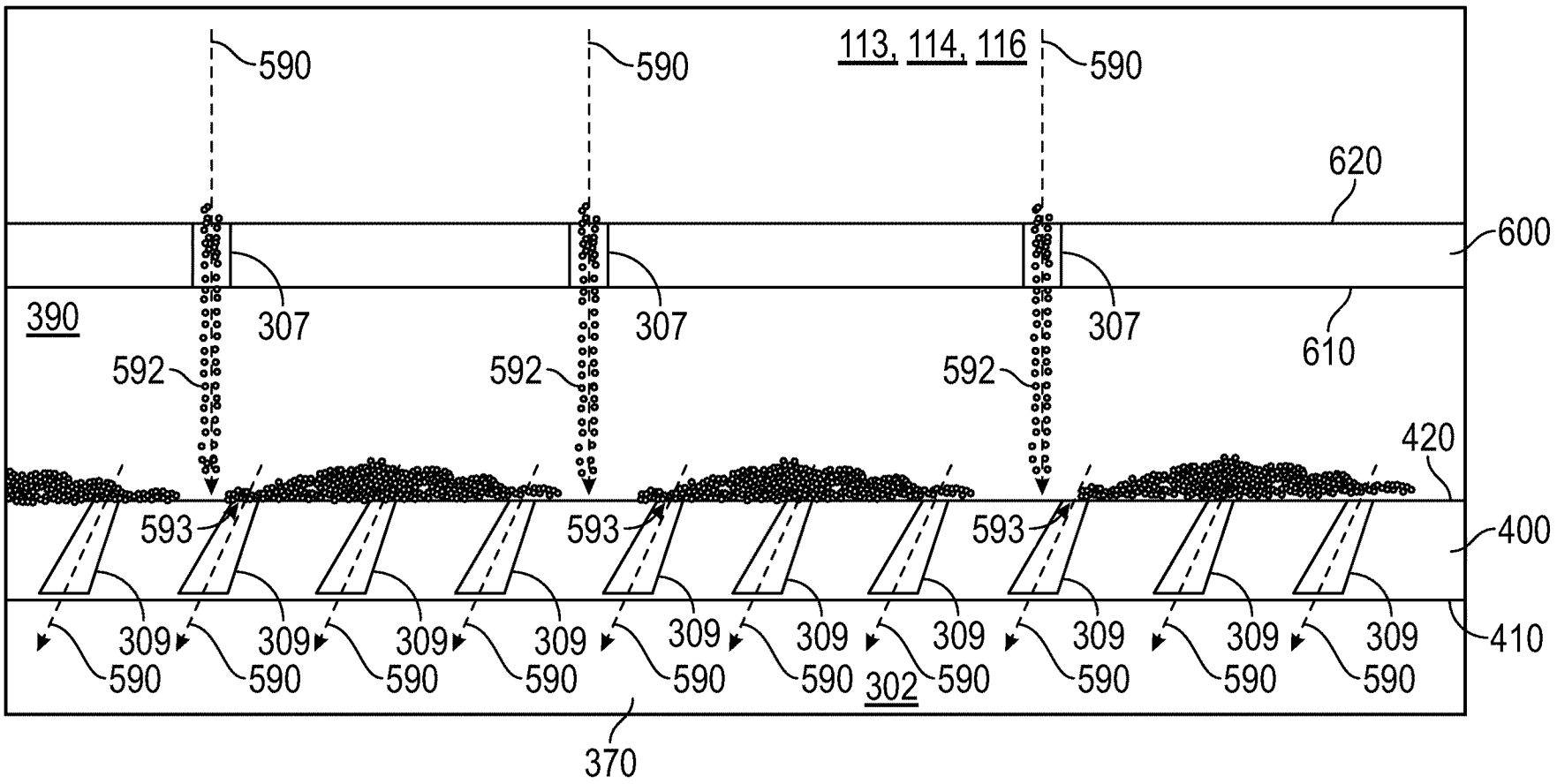
FIG. 3 is an enlarged cross-sectional illustration of a heat shield panel and combustion liner of a combustor, in accordance with an embodiment of the disclosure.

The combustor 300, as shown in FIG. 2, includes multiple heat shield panels 400 that are attached to the combustion liner 600 (See FIG. 3). The heat shield panels 400 may be arranged parallel to the combustion liner 600. The combustion liner 600 can define circular or annular structures with the heat shield panels 400 being mounted on a radially inward liner and a radially outward liner, as will be appreciated by those of skill in the art. The heat shield panels 400 can be removably mounted to the combustion liner 600 by one or more attachment mechanisms 332. In some embodiments, the attachment mechanism 332 may be integrally formed with a respective heat shield panel 400, although other configurations are possible. In some embodiments, the attachment mechanism 332 may be a bolt or other structure that may extend from the respective heat shield panel 400 through the interior surface to a receiving portion or aperture of the combustion liner 600 such that the heat shield panel 400 may be attached to the combustion liner 600 and held in place. The heat shield panels 400 partially enclose a combustion area 370 within the combustion chamber 302 of the combustor 300.

Referring now to FIGS. 3-6 with continued reference to FIGS. 1 and 2. FIG. 3 illustrates a heat shield panel 400 and combustion liner 600 of a combustor 300 (see FIG. 1) of a gas turbine engine 20 (see FIG. 1). The heat shield panel 400 and the combustion liner 600 are in a facing spaced relationship. The heat shield panel 400 includes a first surface 410 oriented towards the combustion area 370 of the combustion chamber 302 and a second surface 420 opposite the first surface 410 oriented towards the combustion liner 600. The combustion liner 600 has an inner surface 610 and an outer surface 620 opposite the inner surface 610. The inner surface 610 is oriented toward the heat shield panel 400. The outer surface 620 is oriented outward from the combustor 300 proximate the inner diameter branch 114 and the outer diameter branch 116.

The combustion liner 600 includes a plurality of impingement holes 307 configured to allow airflow 590 from the inner diameter branch 114 and the outer diameter branch 116 to enter an impingement cavity 390 in between the combustion liner 600 and the heat shield panel 400. Each of the impingement holes 307 extend from the outer surface 620 to the inner surface 610 through the combustion liner 600.

Each of the impingement holes 307 fluidly connects the impingement cavity 390 to at least one of the inner diameter branch 114 and the outer diameter branch 116. The heat shield panel 400 may include one or more secondary apertures 309 configured to allow airflow 590 from the impingement cavity 390 to the combustion area 370 of the combustion chamber 302.

Each of the secondary apertures 309 extend from the second surface 420 to the first surface 410 through the heat shield panel 400. Airflow 590 flowing into the impingement cavity 390 impinges on the second surface 420 of the heat shield panel 400 and absorbs heat from the heat shield panel 400 as it impinges on the second surface 420. As seen in FIG. 3, particulate 592 may accompany the airflow 590 flowing into the impingement cavity 390. Particulate 592 may include but is not limited to dirt, smoke, soot, volcanic ash, or similar airborne particulate known to one of skill in the art. As the airflow 590 and particulate 592 impinge upon the second surface 420 of the heat shield panel 400, the particulate 592 may begin to collect on the second surface 420, as seen in FIG. 3. The particulate 592 may tend to collect at locations on the second surface 420 in between locations on the second surface 420 directly opposite the impingement holes 307. Whereas particulate 592 tends not to collect at locations on the second surface 420 directly opposite impingement holes 307, due to the high flow velocity of airflow 590 flowing through the impingement holes. Away from the locations on the second surface 420 directly opposite impingement holes 307, the airflow 590 tends to slow down and is insufficient to blow away particulate 592 from the second surface, thus allowing particulate to collect upon the second surface 420. Particulate 592 collecting upon the second surface 420 of the heat shield panel 400 reduces the cooling efficiency of airflow 590 impinging upon the second surface 420 and thus may increase local temperatures of the heat shield panel 400 and the combustion liner 600. Particulate 592 collection upon the second surface 420 of the heat shield panel 400 reduces the heat transfer coefficient of the heat shield panel 400. Particulate 592 collection upon the second surface 420 of the heat shield panel 400 may potentially create a blockage 593 to the secondary apertures 309 in the heat shield panels 400, thus reducing airflow 590 into the combustion area 370 of the combustion chamber 302. The blockage 593 may be a partial blockage or a full blockage.

Figure 4:
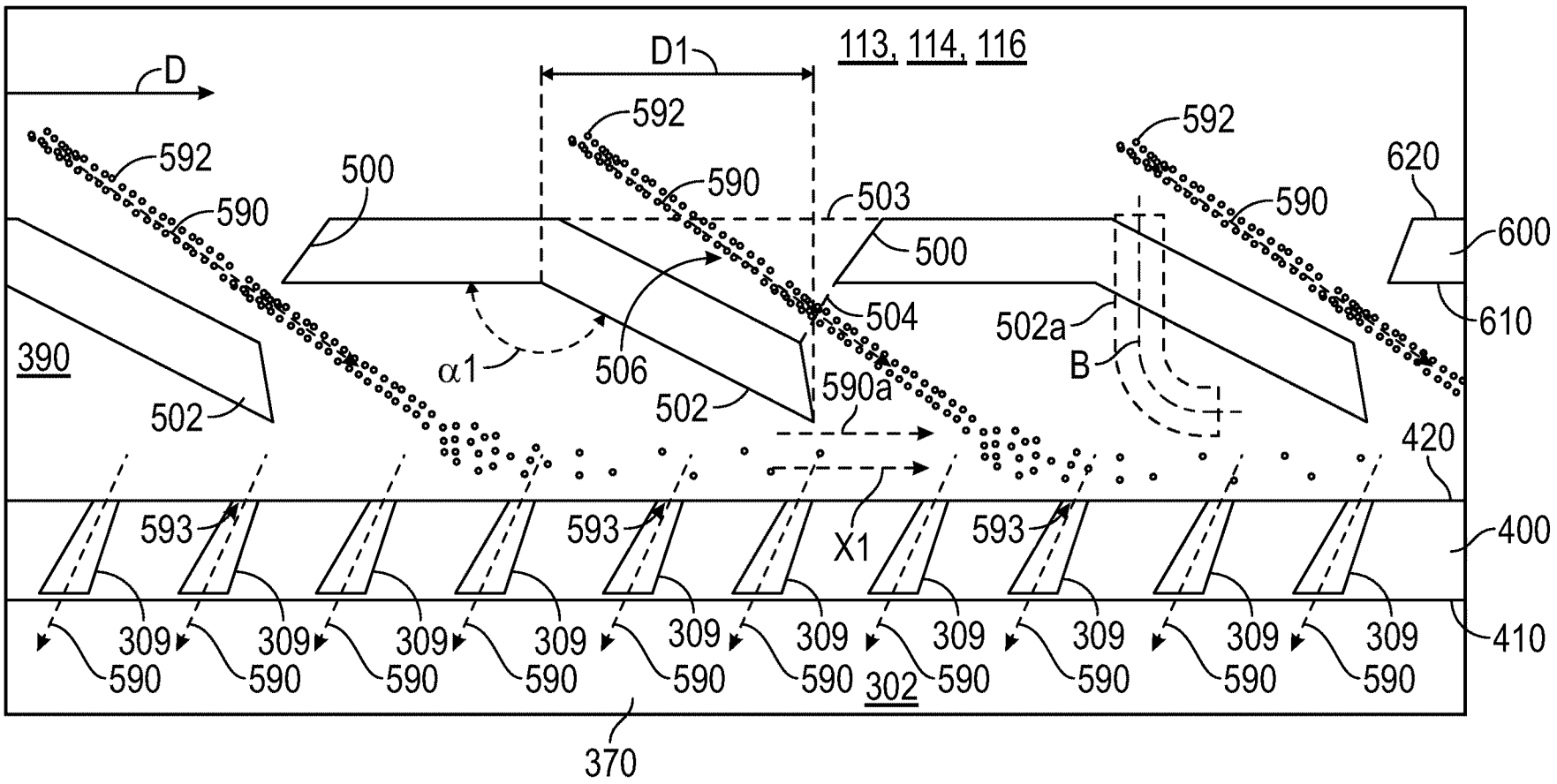
FIG. 4 is an illustration of a configuration of an impingement slot and slot tab for a combustor of a gas turbine engine, in accordance with an embodiment of the disclosure.
Figure 5:
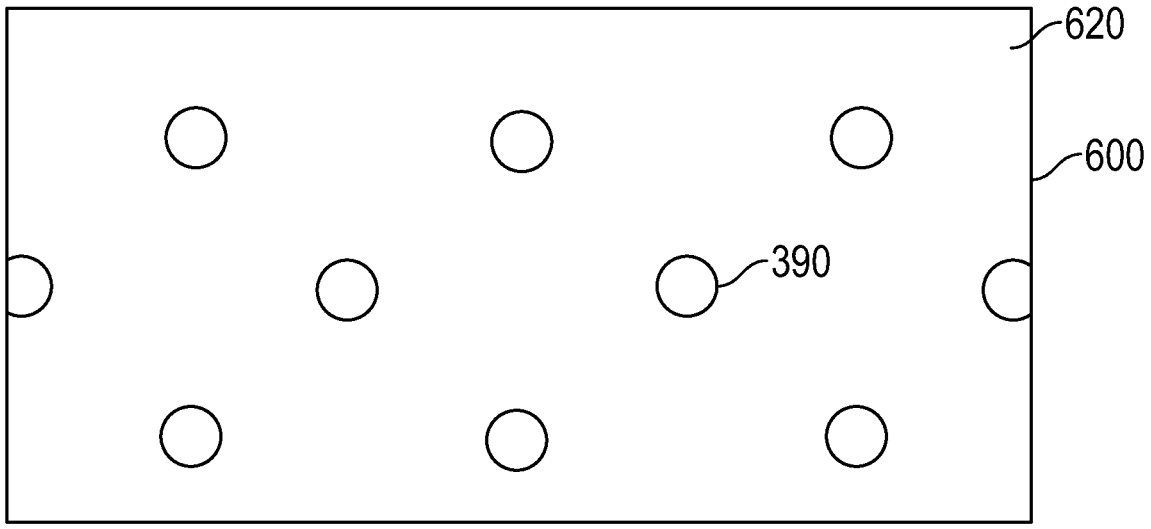
FIG. 5 is a top view of the combustion liner of FIG. 3, in accordance with an embodiment of the disclosure.
Figure 6:
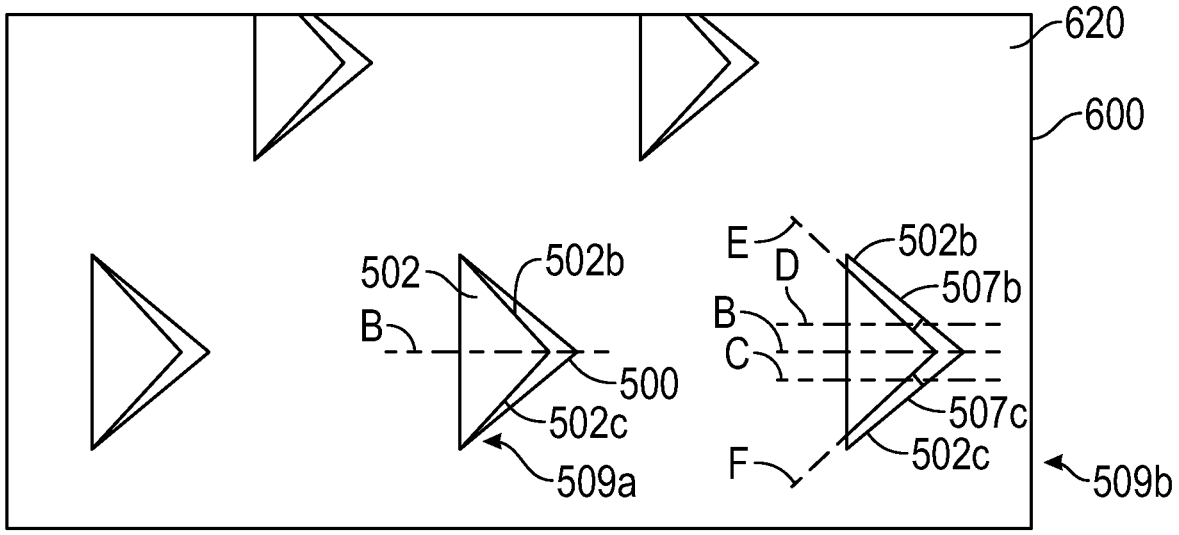
FIG. 6 is a top view of the combustion liner of FIG. 4, in accordance with an embodiment of the disclosure.

The impingement holes 307 may be circular in shape as shown in FIG. 5, which illustrates a top view of the combustion liner 600 looking at the outer surface 620. The circular impingement holes 307 may be formed by various manufacturing methods including but not limited to laser-drilling and electrical discharge machining (EDM). These methods may be time-intensive and may only create a few impingement holes 307 at a time. As shown in FIGS. 4 and 6, impingement slots 500 rather than impingement holes may be utilized to introduce airflow 590 into the impingement cavity 390 to impinge upon the second surface 420 of the heat shield panel 400. The impingement slots 500 may be formed differently than the impingement holes 390, such as, for example, through a punch manufacturing process rather than laser-drilling or EDM, as discussed further below in method 700.

The punch manufacturing process creates the impingement slot 500 and a slot tab 502 configured to direct airflow from an airflow path D into the impingement cavity in about a lateral direction X1 such that a cross flow 590*a* is generated in the impingement cavity 590. The lateral direction X1 may be parallel relative to the second surface 420 of the heat shield panel 400. Advantageously, the addition of the impingement slot 500 and the slot tab 502 to the combustion liner 600 generates a lateral airflow 590*a*, which promotes the movement of particulate 592 through the impingement cavity 390 and towards an exit 392 of the impingement cavity 390, thus reducing the amount of particulate 592 collecting on the second surface 420 of the heat shield panel 400, as seen in FIG. 4. Also advantageously, if the impingement cavity 390 includes an exit 390*a*, the addition of the impingement slot 500 and the slot tab 502 to the combustion liner 600 helps to generate and/or adjust the lateral airflow 590*a*, which promotes the movement of particulate 592 through the impingement cavity 390 and towards the exit 390*a* of the impingement cavity 390 and/or through the secondary apertures 309. Although only three impingement slots 500 and slot tabs 502 are illustrated in FIG. 4, the combustion liner 600 may include any number of impingement slots 500 and slot tabs 502. The impingement slots 500 and slot tabs 502 may be triangular in shape, as shown in FIG. 6, but it is understood that the impingement slots 500 and slot tabs 502 may have a different shape.

The impingement slots 500 and slot tabs 502 are configured to allow airflow 590 in an airflow path D to enter through an inlet 503 proximate the outer surface 620, convey the airflow 590 through a passageway 506, and expel the airflow 590 through an outlet 504 into the impingement cavity 390 in about a lateral direction X1. The passageway 506 fluidly connects the shroud chamber 113, the inner diameter branch 114, and/or the outer diameter branch 116 to the impingement cavity 390. The passageway 506 is fluidly connected to the shroud chamber 113, the inner diameter branch 114, and the outer diameter branch 116 through the inlet 503. The passageway 506 is fluidly connected to impingement cavity 390 through the outlet 504.

During the punch manufacturing process, the slot tab 502 may be bent to a bend angle $\alpha 1$, as shown in FIG. 4. The bend angle $\alpha 1$ at which the slot tab 502 is bent to will adjust the amount of lateral airflow 590*a* created. For example, if the slot tab 502 is bent to a bend angle $\alpha 1$ equal to about 90°, the airflow 590 will largely be directed about perpendicular to the second surface 420 of the heat shield panel 400 and thus created minimal or no lateral airflow 590*a*. Prior to the punch manufacturing process the slot tab 502 is not punched out of the combustion liner and is aligned with the combustion liner 600, thus the bend angle $\alpha 1$ is about 180°, but as the combustion liner 600 gets punched, the slot tab 502 is bent towards the heat shield panel 400 and the bend angle bend angle $\alpha 1$ begins to decrease. When the bend angle $\alpha 1$ is about equal to 90°, the slot tab 502 is about perpendicular to the combustion liner 600. The size of the outlet 504 increases in size as the bend angle $\alpha 1$ decreases in size. The size of the inlet 503 may be dependent upon the shape of the slot tab 502 and a length D1 of the slot tab 502. Further, the slot tab 502 may be bent during the punch manufacturing process to touch the second surface 420 of the heat shield panel 400 depending upon the length D1 of the slot tab 502 and the bend angle $\alpha 1$. Advantageously, by bending the slot tab 502 to touch the second surface 420 the combustion liner 600 may provide additional structural support to the heat shield panel 400.

The lateral airflow 590*a* through the impingement slots 500 and into the impingement cavity 390 may also be adjusted by adjusting the shape of the slot tab 502. For example, the slot tab 502 illustrated in FIG. 4 has a planar or flat shape however the slot tab 502 may be further curved or bent along the length D1 of the slot tab 502 to create a curved shape 502*a* along the length of a longitudinal axis B of the slot tab 502, as shown in FIG. 4. Additionally, as seen at 509*a* on FIG. 6, the edges 502*b*, 502*c* of the slot tab 502 may be bent around a longitudinal axis B of the slot tab 502 to curve the slot tab 502 around the longitudinal axis B to form a semi-tubular shape. In another example, as seen at 509*b* on FIG. 6, the edges 502*b*, 502*c* of the slot tab 502 may be bent around a multiple axis B, C, D, E, F of the slot tab 502 to curve the slot tab 502 around the longitudinal axis B to form a semi-tubular shape and create side guards 507*b*, 507*c* to direct the airflow 590. As seen at 509*b* on FIG. 6, edge 502*b* is bent once at axis D and again at axis E to create the side guard 507*b* and edge 502*c* is bent once at axis C and again at axis F to create the side guard 507*c*. Advantageously, the semi-tubular shape helps to concentrate and direct the lateral airflow 590*a* while preventing airflow 590 leakages around the edges 502*b*, 502*c*.

It is understood that a combustor of a gas turbine engine is used for illustrative purposes and the embodiments disclosed herein may be applicable to additional components of other than a combustor of a gas turbine engine, such as, for example, a first component and a second component defining a cooling channel therebetween. The first component may have impingement slots 500 and slot tabs 502 that direct air through the cooling channel to impinge upon the second component.

Figure 7:
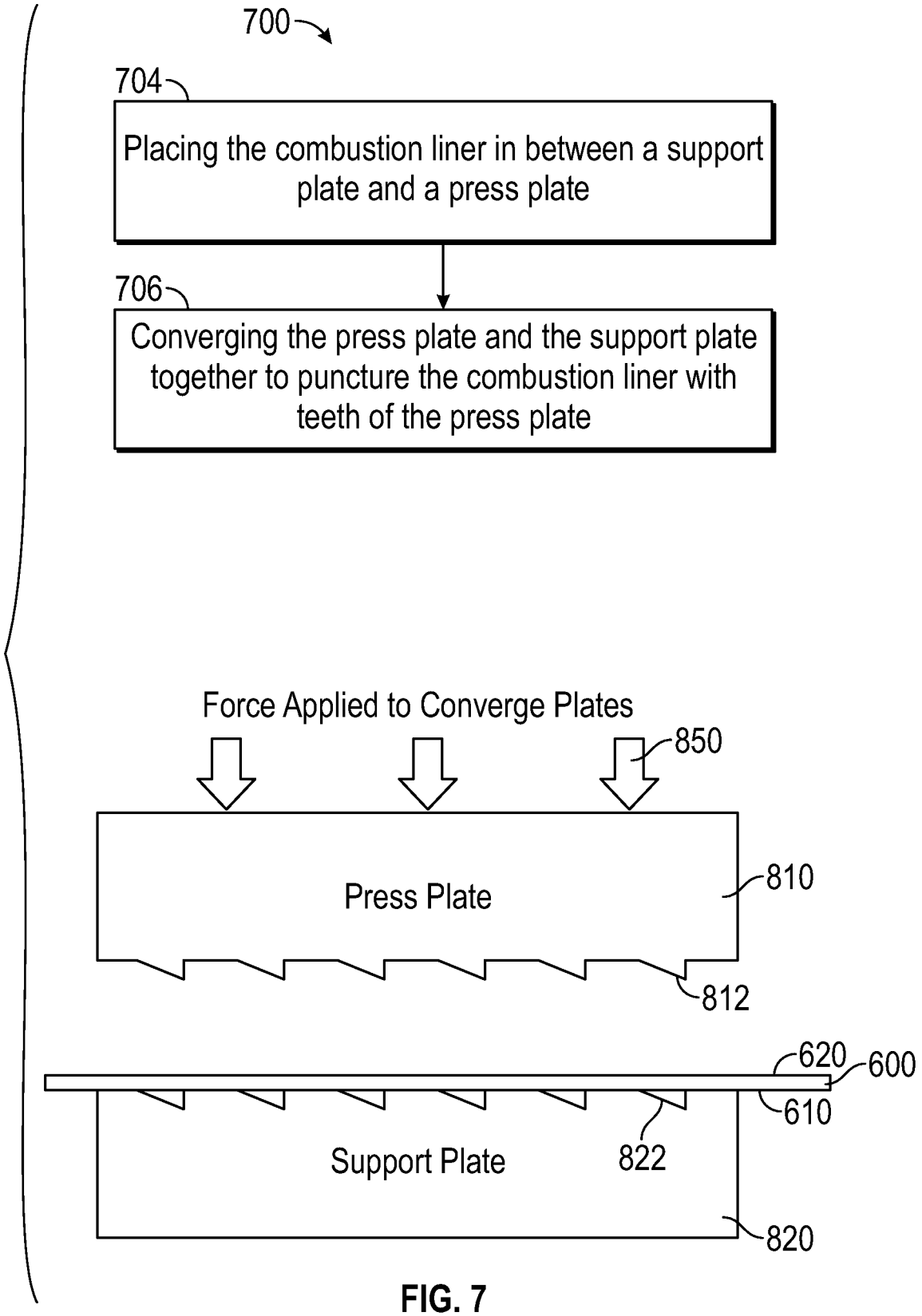
FIG. 7 is an illustration of a method of manufacturing the impingement slot and slot tab of FIG. 4, in accordance with an embodiment of the disclosure.

Referring now to FIG. 7 with continued reference to FIGS. 1-6. FIG. 7 illustrates a method 700 of manufacturing the impingement slots 500 and slot tabs 502. At block 704, a combustion liner 600 is placed in between the support plate 820 and a press plate 810. The combustion liner 600 may be place on a support plate 820, as shown in FIG. 7. The press plate 810 includes teeth 812 shaped to form the impingement slots 500 and the slot tabs 502 in the combustion liner 600. At block 706, the press plate 810 and the support plate are converged together to puncture the combustion liner 600 with the teeth 812 of the press plate 810. The teeth 812 will contact the combustion liner 600 on the outer surface 620, puncture the combustion liner 600, and push the slot tabs 502 through the inner surface 610 of the combustion liner 600. At block 706, a force 850 may be applied to the press plate 810 in order to converge the press plate 810 and the support plate 820. The support plate 820 includes a trough 822 to allow the slot tabs 502 to bend away from the combustion liner 600 when the combustion liner 600 is punctured by the teeth 812. As shown in FIG. 7, the trough 822 may be shaped to mirror the teeth 812 of the press plate 810, such that when the teeth 812 bend the slot tabs 502 to a selected bend angle $\alpha 1$ the slot tabs 502 are supported by the trough 822. Advantageously, by supporting the slot tabs 502 with the trough 822, the trough 822 may help prevent the slot tabs 502 from breaking entirely off of the combustion liner 600. Further, the teeth 812 and trough 822 may be shaped to the desired shape of the slot tabs 502, such that when the teeth 812 bend the slot tabs 502 to a selected bend angle $\alpha 1$ the slot tabs 502 are shaped by the teeth 812 and the trough 822. For example, a curve slot tab 502 may require a curved tooth 812 and a curved trough 822.

Technical effects of embodiments of the present disclosure include forming an impingement slot and a slot tab in a combustion liner through a punch manufacturing process, such that the slot and slot tab introduce lateral airflow across a heat shield panel surrounding a combustion area of a combustion chamber to help reduce collection of particulates on the heat shield panel and also help to reduce entry of the particulate into the combustion area.

The term "about" is intended to include the degree of error associated with measurement of the particular quantity based upon the equipment available at the time of filing the application. For example, "about" can include a non-limiting range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine component assembly, comprising:

a first component having a first surface and a second surface opposite the first surface; and a second component having a first surface, a second surface opposite the first surface of the second component, and an impingement slot extending from the second surface of the second component to the first surface of the second component, the second surface of the first component and the first surface of the second component defining a cooling channel therebetween in fluid communication with the impingement slot, wherein the impingement slot is in fluid communication with the second surface of the first component, wherein the impingement slot includes an inlet and a slot tab configured to direct airflow into the cooling channel at least partially in a lateral direction parallel to the second surface of the first component such that a cross flow is generated in the cooling channel, wherein the impingement slot and the slot tab are triangular in shape, wherein the slot tab is a portion of the second component that has been punched out of the second component and bent away from the second component into the cooling channel to a non-perpendicular angle between the first surface of the second component and an inner surface of the slot tab by a punch manufacturing process, a size of the inlet being dependent upon a shape of the slot tab and a length of the slot tab, the slot tab being bent away from the second component at a fold line, and wherein the slot tab is curved around a longitudinal axis of the slot tab, the longitudinal axis extending perpendicularly from the fold line to a corner of the slot tab.

2. The gas turbine engine component assembly of claim 1, wherein the slot tab is curved along the longitudinal axis of the slot tab.

3. A combustor for use in a gas turbine engine, the combustor enclosing a combustion chamber having a combustion area, wherein the combustor comprises:

a heat shield panel having a first surface and a second surface opposite the first surface; and a combustion liner having an inner surface, an outer surface opposite the inner surface of the combustion liner, and an impingement slot extending from the outer surface of the combustion liner to the inner surface of the combustion liner, the second surface of the heat shield panel and the inner surface of the combustion liner defining an impingement cavity therebetween in fluid communication with the impingement slot for cooling the second surface of the heat shield panel, wherein the impingement slot includes an inlet and a slot tab configured to direct airflow into the impingement cavity at least partially in a lateral direction parallel to the second surface of the heat shield panel such that a cross flow is generated in the impingement cavity, wherein the impingement slot and the slot tab are triangular in shape, wherein the slot tab is a portion of the combustion liner that has been punched out of the combustion liner and bent away from the combustion liner into the impingement cavity to a non-perpendicular angle between the inner surface of the combustion liner and an inner surface of the slot tab by a punch manufacturing process, a size of the inlet being dependent upon a shape of the slot tab and a length of the slot tab, the slot tab being bent away from the combustion liner at a fold line, and wherein the slot tab is curved around a longitudinal axis of the slot tab, the longitudinal axis extending perpendicularly from the fold line to a corner of the slot tab.

4. The combustor of claim 3, wherein the slot tab is curved along the longitudinal axis of the slot tab.

5. The gas turbine engine component assembly of claim 1, wherein the slot tab further comprises side guards.

6. The combustor of claim 3, wherein the slot tab further comprises side guards.

* * * * *